US012560057B1

(12) United States Patent
Arabie et al.

(10) Patent No.: US 12,560,057 B1
(45) Date of Patent: Feb. 24, 2026

(54) METHOD AND APPARATUS FOR PERFORMING DOWNHOLE OPERATIONS, INCLUDING PERFORATING AND CEMENTING OPERATIONS

(71) Applicant: Oilfield Service Professionals, Inc., Houston, TX (US)

(72) Inventors: Blake Arabie, Lafayette, LA (US); Scotty Verret, Carencro, LA (US)

(73) Assignee: Oilfield Service Professionals, LLC, Houston, TX (US)

( * ) Notice: Subject to any disclaimer, the term of this patent is extended or adjusted under 35 U.S.C. 154(b) by 0 days.

(21) Appl. No.: 18/938,950

(22) Filed: Nov. 6, 2024

Related U.S. Application Data

(60) Provisional application No. 63/596,945, filed on Nov. 7, 2023.

(51) Int. Cl.
*E21B 43/119* (2006.01)
*E21B 33/14* (2006.01)

(52) U.S. Cl.
CPC ..... *E21B 43/119* (2013.01); *E21B 33/14* (2013.01)

(58) Field of Classification Search
CPC ..... E21B 29/005; E21B 29/007; E21B 43/112
See application file for complete search history.

(56) References Cited

U.S. PATENT DOCUMENTS

| | | | | |
|---|---|---|---|---|
| 10,808,479 | B2 * | 10/2020 | DiRocco | E21B 33/10 |
| 11,767,732 | B2 * | 9/2023 | Harms | E21B 33/13 166/250.01 |
| 2016/0376869 | A1 * | 12/2016 | Rochen | E21B 33/128 166/135 |
| 2020/0056446 | A1 * | 2/2020 | Al-Mousa | E21B 33/1293 |
| 2021/0054708 | A1 * | 2/2021 | Al-Mousa | E21B 33/134 |

* cited by examiner

*Primary Examiner* — Yanick A Akaragwe
(74) *Attorney, Agent, or Firm* — Ted M. Anthony

(57) ABSTRACT

Methods for using perforating tools and downhole wellbore isolation devices in various combinations and configurations in order to perform downhole perforating and cementing operations. Perforating is performed using at least one mechanical perforating device. Cementing operations can include block squeeze jobs (wherein the casing is selectively perforated and cement slurry is pumped through said perforations) or cement spotting jobs (wherein a predetermined volume of cement is deposited in the inner bore of a casing string to act as a "plug").

18 Claims, 15 Drawing Sheets

METHOD AND APPARATUS FOR PERFORMING DOWNHOLE OPERATIONS, INCLUDING PERFORATING AND CEMENTING OPERATIONS

CROSS REFERENCES TO RELATED APPLICATIONS

THIS APPLICATION CLAIMS PRIORITY OF U.S. PROVISIONAL PATENT APPLICATION Ser. No. 63/596,945, FILED Nov. 7, 2023, INCORPORATED BY REFERENCE HEREIN.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to methods and apparatuses for conducting certain downhole operations in wellbores that extend into subterranean formations. More particularly, the present invention pertains to methods and apparatuses for perforating casing or other tubular goods at desired interval(s) within said wellbores. More particularly still, the present invention pertains to use of certain bottom hole assemblies in various configurations in order to perform downhole operations including, without limitation, perforating and cementing operations.

2. Description of Related Art

After a wellbore has been drilled to a desired depth, large diameter pipe known as "casing" is frequently installed in said wellbore and cemented in place. The casing is typically installed into the wellbore in a number of separate sections of substantially equal length called "joints"; the joints are typically screwed together or otherwise joined in end-to-end relationship in order to form a substantially continuous "string" of pipe that extends downward a desired distance into the earth's crust.

After a casing string has been installed in a wellbore, a cement slurry is typically pumped into the central through bore of the casing. After a predetermined volume of cement has been pumped, a plug or wiper assembly is then pumped down the inner bore of the casing using drilling mud or other fluid in order to fully displace the cement from the inner bore of the casing. As a result, the cement slurry leaves the inner bore of the casing, flows out the distal/bottom end of the casing string, and enters the annular space existing between the outer surface of the casing and the inner surface of the wellbore. The cement slurry eventually hardens to form a cement sheath around the exterior surface of the casing string, beneficially securing the casing in place and forming a fluid barrier to prevent a fluid flow path along the outer surface of the casing.

It is frequently beneficial to perforate (that is, create transverse holes that extend through) the casing and any surrounding cement sheath present along the external surface of the casing. Conventional perforating operations typically employ shaped explosive charges that focus the effect of explosive energy toward the inner wall of the surrounding casing; the shaped explosive charges penetrate the casing and any external cement sheath, thereby perforating the casing and cement at predetermined locations or intervals.

Notwithstanding the foregoing, in certain instances well casing is perforated in a more controlled and reliable manner. In such instances, specialized mechanical perforating tools can be used to selectively punch holes through the casing and any surrounding cement or other material. Generally, said mechanical perforating tools are conveyed in and out of wellbores utilizing a tubular work string, such as drill pipe or other threaded tubular goods. The mechanical perforating tools can be positioned (and/or repositioned) within a wellbore using the tubular work string, and selectively actuated in order to perforate the surrounding casing at predetermined location(s) in said wellbore.

The tubular work string can also be utilized as a conduit to pump fluids (such as, for example, drilling mud, water or completion fluids) to a bottom hole assembly ("BHA") which may include at least one mechanical perforating tool, as well as other downhole devices. Additionally, the weight of said work string can also be beneficially used to manipulate and/or function components of a BHA including, without limitation, a mechanical perforating tool and/or wellbore isolation tools. The weight of the work string can be selectively "picked up" in order to decrease loading on a BHA, or "slacked off" in order to increase loading on said BHA.

In many cases, it is also beneficial to utilize other downhole tools such as packers and/or bridge plugs in connection with such downhole perforating operations. Packers generally comprise tools used in the oilfield to isolate certain downhole section(s) of a wellbore (such as, for example, a portion of a well passing through a subterranean reservoir) from certain other downhole section(s) within said wellbore (such as, for example, a portion of a well passing through a different subterranean reservoir).

Generally, packers can be "permanent" or "retrievable". Permanent packers are designed for a single use in a wellbore, while retrievable packers are designed to be used multiple times over the life of the packer. Retrievable packers are also typically conveyed into a wellbore and set at a desired location within said wellbore using a tubular work string. In most cases, when a packer is set within a wellbore, at least one slip system of the packer can be selectively engaged to frictionally anchor the packer against the inner surface of the surrounding casing in order to prevent unwanted movement of the packer within the wellbore. Additionally, rubber and/or other elastomeric sealing elements disposed on the packer expand radially outward to form a fluid pressure seal against said inner surface of said surrounding wellbore.

Bridge plugs and cement retainers are also used to isolate certain sections of a wellbore from other section(s) of the wellbore. Said bridge plugs and cement retainers also generally comprise anchoring means to selectively secure the bridge plugs or cement retainers against the inner surface of a surrounding casing string, as well as sealing elements that can be selectively engaged to form a fluid pressure seal against said inner surface of the surrounding casing.

In many instances it is desirable to deposit cement—in addition to cement that is originally deposited in place—in or around the casing. By way of example, but not limitation, it is often beneficial to selectively perforate a casing string in a desired location and inject (or "squeeze") cement slurry into void space(s) existing along the external surface of the casing. Similarly, it is often desirable to deposit (or "spot") a cement plug at a desired depth within the internal bore of a casing string.

Conventional means of depositing cement in and/or around wellbores typically require multiple trips in and out of a wellbore, often with both tubular work strings, as well as wireline conveyed tools. Such multiple trips are frequently time consuming, resulting in increased expense and time delay. Thus, there is a need for improved methods for using mechanical perforating tools and downhole wellbore isolation devices in various combinations and configurations while performing downhole perforating operations and/or cementing in a quicker and more efficient manner than conventional methods.

SUMMARY OF THE INVENTION

The present invention pertains to methods and apparatuses for conducting certain downhole operation is wellbore (s) that extend into subterranean formations. Although other devices can be used without departing from the scope of the present invention, it is to be understood that the various devices may be beneficially utilized in the present invention including, without limitation, the following:

Mechanical Perforating Device

A mechanical perforating device is safe and explosive-free, can be easily transported to remote locations (such as drilling rig or marine installation) with greatly reduced danger to property and/or personnel, and allows for limited space requirements. Further, the subject mechanical perforating device permits a virtually unlimited number of repeatable cuts or perforations per run within a wellbore. As such, said mechanical perforating device allows continuous casing cutting and perforating operations until desired fluid flow rates (in or out) of the surrounding casing are achieved.

Said mechanical perforating device uses hydraulically generated energy to force at least one cutting blade radially outward from a central tool body toward the inner surface of surrounding casing. As said at least one blade extends radially outward, the blade(s) contact the surrounding casing and eventually pierce and/or penetrate said casing in order to form transverse holes or perforations that extend through the casing. Unlike conventional explosive-type perforating tools, a mechanical perforating apparatus is fully compatible with and can be run with bridge plugs, packers, and other conventional wellbore cleaning devices.

Retrievable Service Packer

A retrievable service packer can be used to isolate at least one section(s) of a wellbore from other section(s) of said wellbore. In a preferred embodiment, said retrievable service packer includes at least one relatively large integral internal bypass flow channel; the large flow area of said bypass flow channel allows for increased run speeds while running in an out of wellbore, thereby reducing surge and/or swab pressures. Said relatively large internal bypass flow channel also permits increased circulating flow rates. As such, said relatively large internal bypass flow channel saves valuable rig time when tripping in and out of a wellbore, or when performing fluid displacements. Said retrievable service packer permits a mechanical perforating system to penetrate a surrounding casing string and maintain wellbore integrity when said packer is set within a wellbore.

Further, said retrievable service packer of the present invention utilizes a simple setting feature—for example, in a preferred embodiment, a quarter turn at the tool allows for the tool to be set with setting force (loading) imposed from above or below the packer. The packer can also be quickly unset by picking up on the work string and reducing weight/loading on said packer.

Dart Catcher/Ball Sub

In a preferred embodiment, the present invention can include an optional dart catcher/ball sub. Said dart catcher/ball sub provides a seat upon which a dropped object (such as a ball or dart that can be dropped into the work string from the surface) can land. After landing on the seat, said dropped object provides a positive barrier that obstructs fluid flow through said seat, thereby allowing for pumped fluid to generate a fluid pressure differential across said (blocked) seat. Said fluid pressure differential can be selectively used to activate a perforating system or other downhole device(s) using predetermined pump pressure. Further, a configurable shear valve allows for use of a predetermined range of cutting and/or deactivation pressures.

Mechanical Setting Tool (MST)

A mechanical setting tool provides a mechanism to permit slips (typically upper slips) of a drillable cement retainer/bridge plug to be released with rotation(s) (typically right-handed rotation). Said mechanical setting tool also allows a drillable cast-iron bridge plug and/or composite drillable cement retainer to be selectively set. Said mechanical setting tool can be used to open and close a sleeve valve inside a cement retainer with upward or downward movement of a work string. Said mechanical setting tool further provides an upward stop as a work string is raised; when raised into contact with a cement retainer, a snap latch feature latches into a said cement retainer with set down weight from a work string, and is released with tension providing slight overpull indication that a cement retainer has been released and a sleeve valve has been closed.

Cast-Iron Bridge Plug

Bridge plugs are also commonly used during oil and gas operations to isolate certain downhole region(s) of a wellbore from certain other downhole region(s) of said wellbore. A bridge plug can also be selectively set downhole at a desired location within a wellbore to establish a fluid pressure seal or pressure barrier within said wellbore. Some bridge plugs are designed to be retrievable from a wellbore, while others are intended to be permanently set in place.

Drillable Cement Retainer

A drillable cement retainer can be utilized for most cementing applications. Said drillable cement retainer is designed to function as a drillable squeeze packer which, after cementing, acts as a plug, that traps pressurized cement slurry below the retainer. Further, the drillable cement retainer isolates the newly cemented area from fluid pressures present above said cement retainer.

Multiple downhole operations (including, without limitation, perforating and cementing operations) can be performed using various combination(s) of the above referenced equipment as more fully set forth herein. More specifically, the present invention provides improved methods for using perforating tools and downhole wellbore isolation devices in various combinations and configurations in order to perform downhole perforating and cementing operations. Said cementing operations can include block squeeze jobs (wherein the casing is selectively perforated and cement slurry is pumped through said perforations) or cement spotting jobs (wherein a predetermined volume of cement is deposited in the inner bore of a casing string to act as a "plug").

Unlike conventional means of depositing cement in and/or around wellbores, multiple pipe and/or wireline trips in and out of a wellbore are not required. By using mechanical perforating tools and downhole wellbore isolation devices in various combinations and configurations, downhole perforating and cementing operations can be performed in a quicker and more efficient manner.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT OF THE INVENTION

Figure 1:
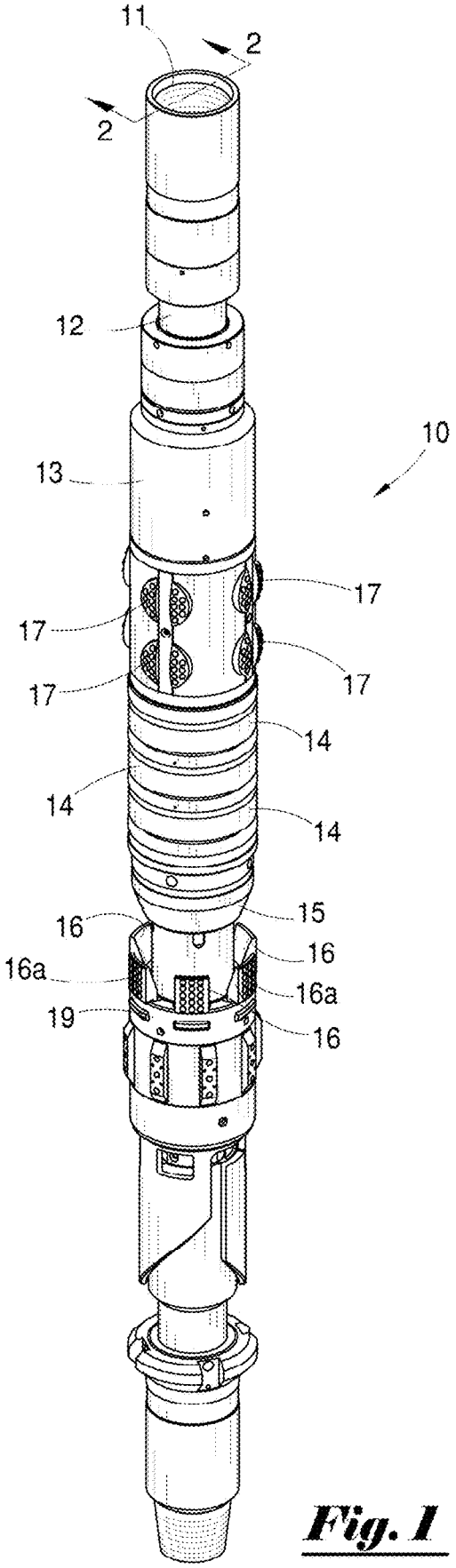
FIG. 1 depicts a side perspective view of a retrievable service packer.

Before describing various embodiments of the present disclosure in further detail by way of exemplary description, examples, and results, it is to be understood that the apparatus and methods of the present disclosure are not limited in application to the details of specific embodiments and examples as set forth in the following description. The description provided herein is intended for purposes of illustration only and is not intended to be construed in a limiting sense. As such, the language used herein is intended to be given the broadest possible scope and meaning, and the embodiments and examples are meant to be exemplary, not exhaustive. Also, it is to be understood that the phraseology and terminology employed herein is for the purpose of description only and should not be regarded as limiting unless otherwise indicated as so. Moreover, in the following detailed description, numerous specific details are set forth in order to provide a more thorough understanding of the present disclosure.

It will be apparent to a person having ordinary skill in the art that the present disclosure may be practiced without these specific details. In other instances, features which are well known to persons of ordinary skill in the art have not been described in detail to avoid unnecessary complication of the description. It is intended that all alternatives, substitutions, modifications, and equivalents apparent to those having ordinary skill in the art are included within the scope of the present disclosure. Thus, while the apparatus and methods of the present disclosure have been described in terms of particular embodiments, it will be apparent to those of skill in the art that variations may be applied to the apparatus and methods and the steps or in the sequence of steps of the methods described herein without departing from the concept, spirit, and scope of the inventive concepts. Referring to the drawings, like numerals indicate like or corresponding parts throughout the several views.

Moreover, it will be understood that various directions such as "upper", "lower", "bottom", "top", "left", "right", and so forth are made only with respect to explanation in conjunction with the drawings, and dimensions and material selections set forth herein and in the appended drawings are exemplary only. As a result, components may be oriented differently, for instance, during transportation and manufacturing as well as operation, may have different dimensions, and may be made of different material(s) having satisfactory characteristics. Because many varying and different embodiments may be made within the scope of the concept(s) herein taught, and because many modifications may be made in the embodiments described herein, it is to be understood that the details herein are to be interpreted as illustrative and non-limiting. As used herein, the term "sub" is intended to generically refer to a section or a portion of a tool string. While a sub may be modular and use threaded connections, no particular configuration is intended or implied by the use of the term sub.

Figure 2A:
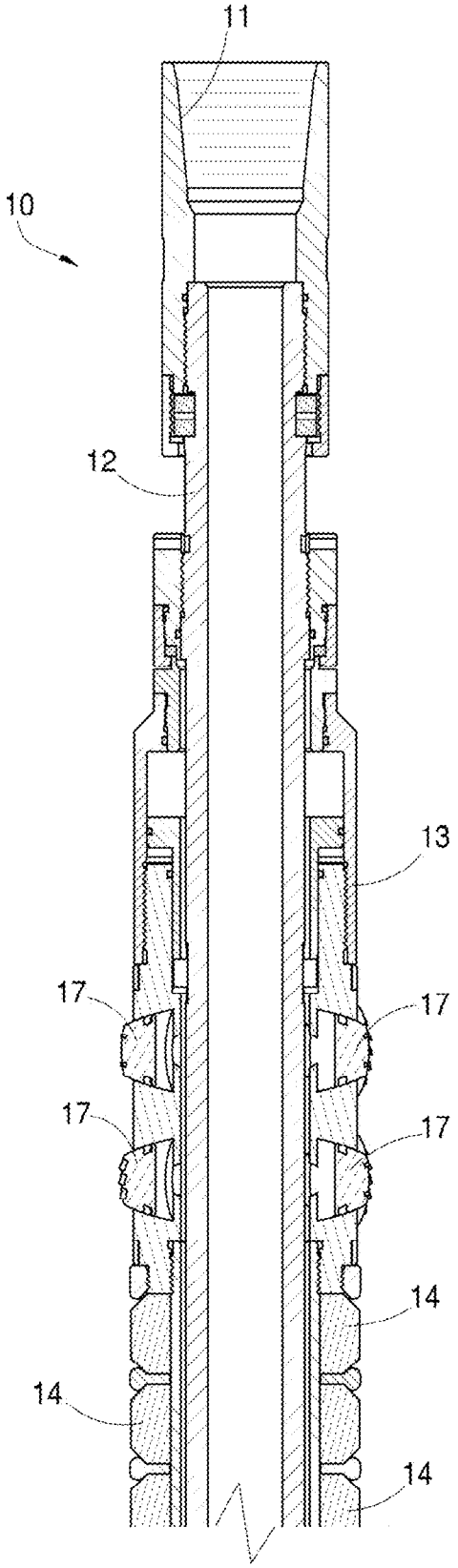
FIGS. 2A and 2B depict side sectional views of said retrievable service packer.
Figure 2B:
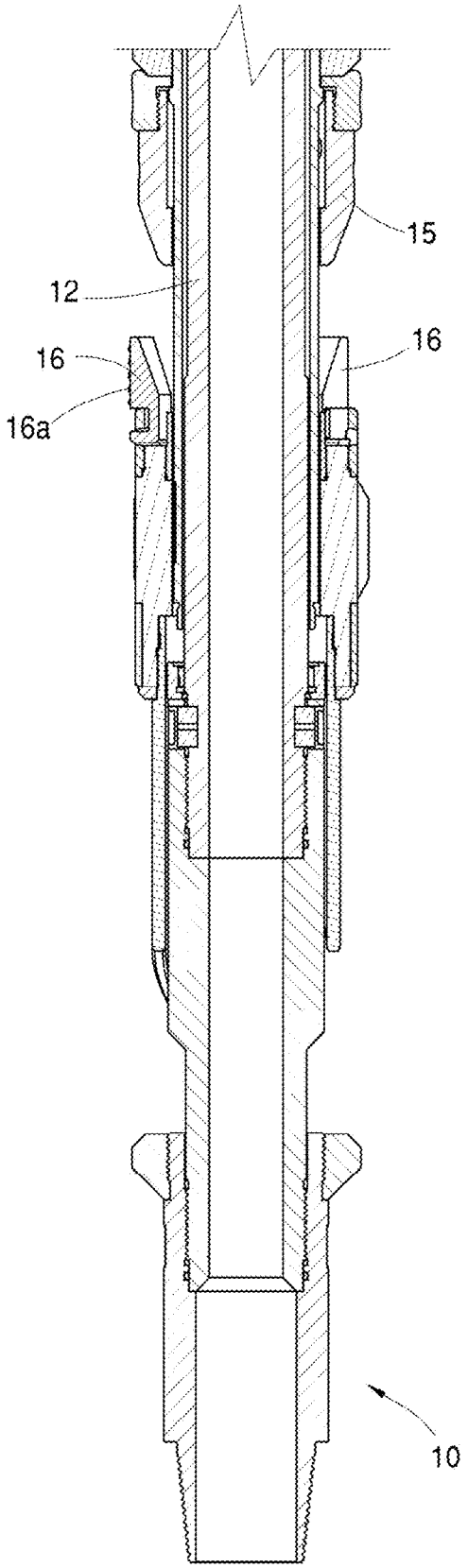

FIG. 1 depicts a side perspective view of a retrievable service packer 10, while FIGS. 2A and 2B depict side sectional views of said retrievable service packer 10. Said retrievable service packer 10 can be used to isolate at least one section of a wellbore from other sections or regions of said wellbore. In a preferred embodiment, said retrievable service packer 10 generally comprises a central mandrel 12 having an upper connection member 11. In the embodiment depicted in FIG. 1, said upper connection member 11 comprises a threaded female or "box-end" connection that can be used to connect said service packer 10 to a tubular work string or other component of bottom hole assembly/BHA.

Service packer 10 further comprises body member 13 and central mandrel 12. A plurality of hold down buttons 17 are disposed within body member 13. Slip ring 19 and slip cone 15 are disposed around central mandrel 12. At least one rubber or elastomeric sealing member 14 is also disposed around said central mandrel 12. A plurality of slip members 16 is operationally attached to moveable slip ring 16. Each slip member 16 can have raised or textured outer surfaces 16*a* to enhance frictional gripping force when said slip members 16 are extended radially outward to engage against and grip against a surrounding wellbore surface.

Said retrievable modular packer/bridge plug apparatus 10 of the present invention can be conveyed into a wellbore, and manipulated therein, utilizing a tubular work string. In this configuration, an integral internal fluid bypass (flow path) of the retrievable service packer 10 is fully open to fluid flow. Further, slip members 16 are fully retracted radially inward. Similarly, said at least one rubber or elastomeric sealing member 14 is not compressed and energized; as such, said sealing members 14 are not expanded radially outward. The large flow area of said at least one large integral bypass flow channel allows for increased run speeds and circulation rates while reducing surge and/or swab pressures. As a result, said retrievable service packer can be run more quickly, thereby saving valuable rig time when tripping in and out of a wellbore, or when performing fluid displacements.

Further, said retrievable service packer 10 of the present invention utilizes a relatively simple setting feature—for example, in a preferred embodiment, a quarter turn of the work string allows for the tool to be set with setting force (loading) imposed from above or below said service packer 10. The service packer 10 can also be quickly unseated (unset) and retrieved by picking up weight from the work string and reducing weight/loading on said service packer 10. Other components of conventional retrievable service packer 10 are also depicted in FIGS. 1 and FIGS. 2A-2B that are not expressly expanded upon in detail herein yet are well known to those having ordinary skill in the art.

Figure 3:
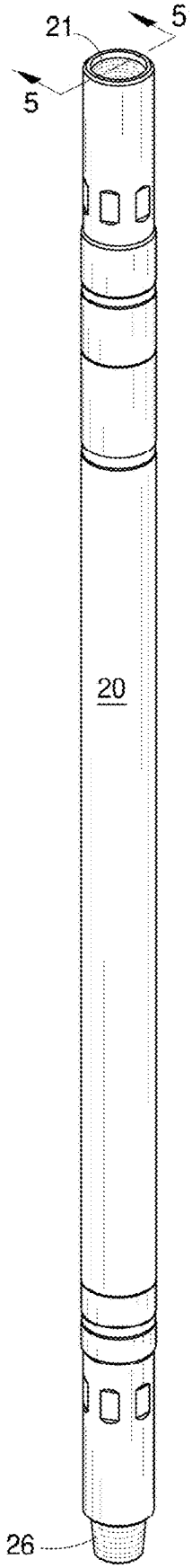
FIG. 3 depicts a side sectional view of a dart catcher and ball sub assembly.
Figure 5A:
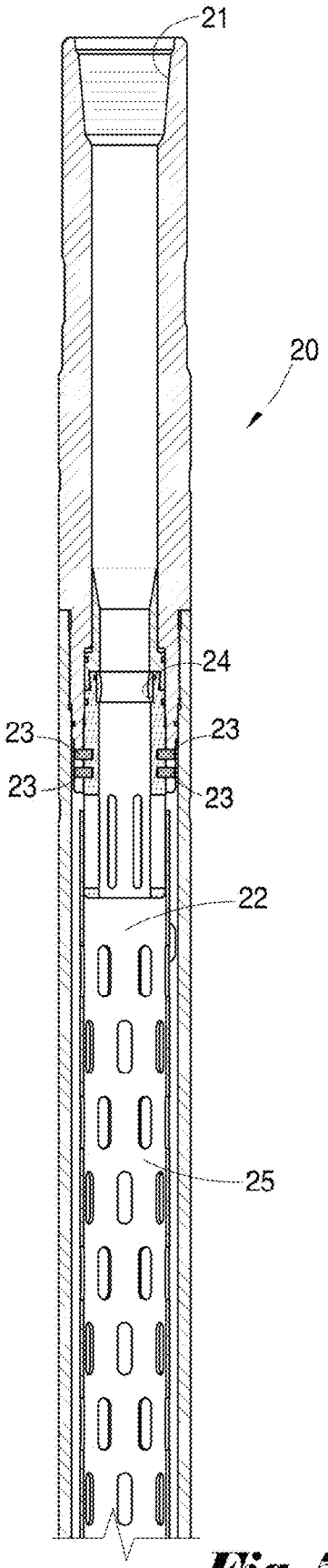
FIGS. 5A and 5B depict side sectional views of the dart catcher and ball sub assembly along line 5-5 of FIG. 3.
Figure 5B:
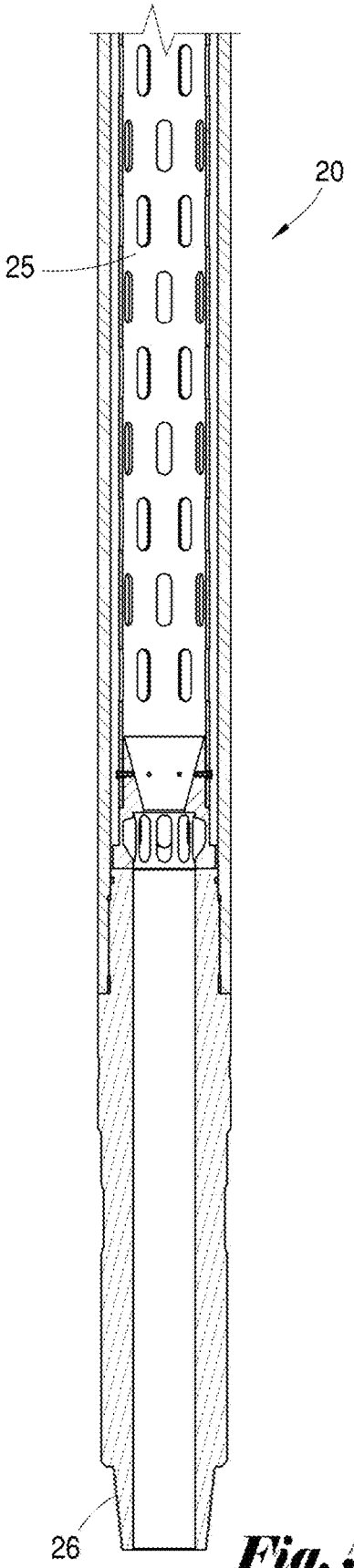

FIG. 3 depicts a side sectional view of a dart catcher/ball sub 20, while FIGS. 5A and 5B depict side sectional views of said dart catcher/ball sub 20 along line 5-5 of FIG. 3. In a preferred embodiment, said dart catcher/ball sub 20 comprises an upper connection member 21, which can be a threaded female or "box-end" connection, as well as lower connection member 26, which can be a threaded male or "pin end" connection. Connection members 21 and 26 can be used to connect said dart catcher and ball sub 20 to a tubular work string or other component of bottom hole assembly/BHA. Referring to FIGS. 5A and 5B, said dart catcher/ball sub 20 further comprises an internal perforated sleeve 25 defining a central through bore 22.

A seat member 24 is disposed in said central through bore and provides a support upon which a dropped object (such as a ball or dart that can be dropped into the work string from the surface) can land. After landing on the seat member 24, said dropped object provides a positive barrier that obstructs fluid flow through said central through bore 22 and seat member 24, thereby allowing for pumped fluid to generate a fluid pressure differential across said (blocked) seat. Said fluid pressure differential can be selectively used to activate a perforating system or other downhole device(s) using predetermined pump pressure(s).

Seat 24 is further secured in place using at least one shearable object 23 (such as a shear pin, shear ring or the like). When said pressure differential exceeds a predetermined value, said at least one shearable object 23 can shear or separate, thereby permitting seat 24 to shift into a different position within through bore 22. After said seat 24 shifts, said obstruction to fluid flow is at least partially relieved, and fluid can flow through central bore 22 of dart catcher/ball sub 20.

Figure 4:
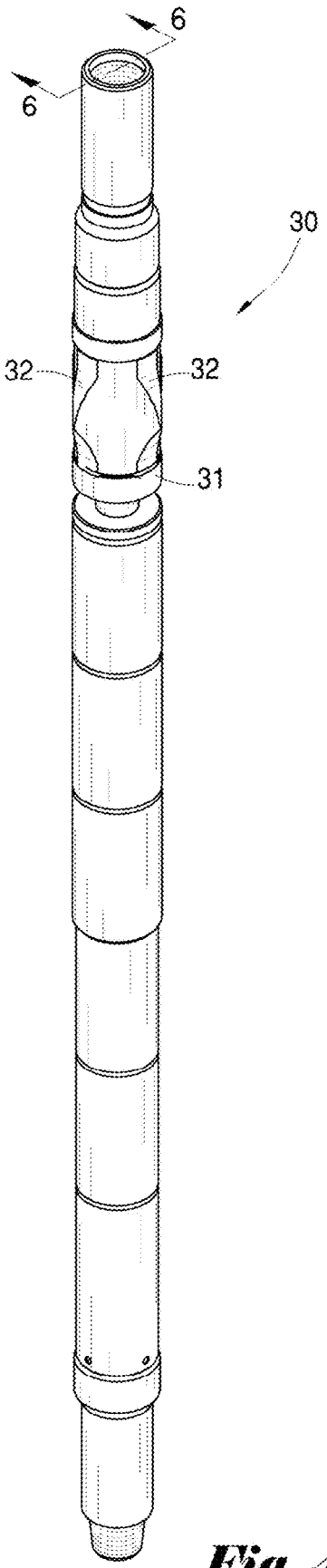
FIG. 4 depicts a side perspective view of a mechanical perforating assembly.
Figure 6A:
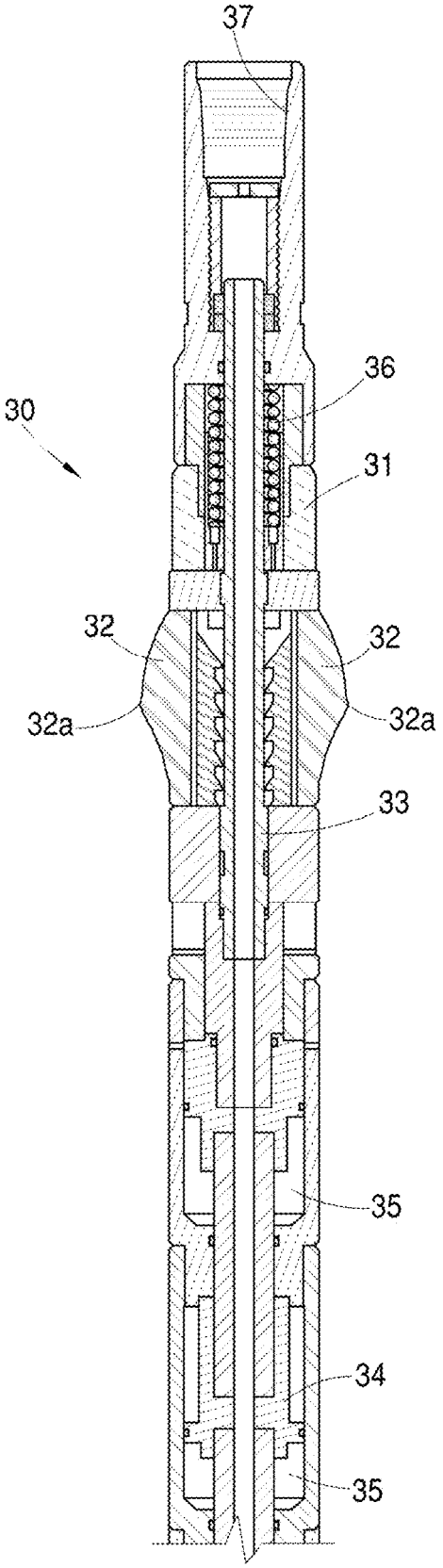
FIGS. 6A and 6B depict side sectional views of the mechanical perforating assembly along line 6-6 of FIG. 4.
Figure 6B:
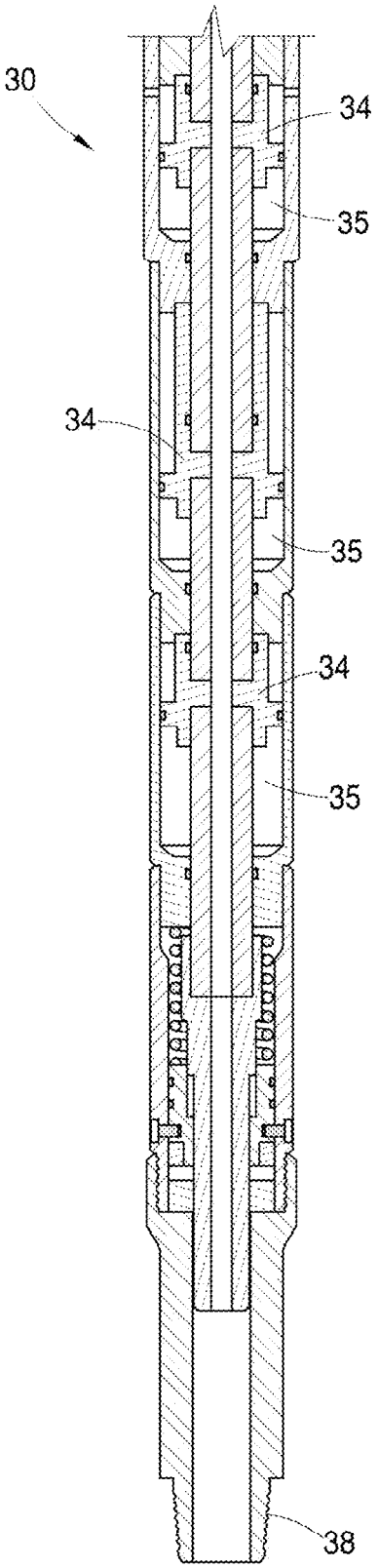

FIG. 4 depicts a side perspective view of a mechanical perforating assembly 30, while FIGS. 6A and 6B depict side sectional views of said mechanical perforating assembly 30 along line 6-6 of FIG. 4. Mechanical perforating assembly 30, which is configured to perforate a downhole well casing, comprises a body 31 arranged to be disposed in a well casing and at least one cutter block 32 moveable relative to said body 31; said at least one cutter block 32 can alternate between an inwardly radially-retracted position and outwardly radially-extended position.

Referring to FIGS. 6A and 6B, an activation member 33 is movably disposed within said body 31, wherein the activation member 33 is moveable relative to the body 31. A plurality of pistons 34 is arranged to move said activation member 33 relative to said body 31. Each piston 34 is itself moveably disposed in a respective pressure chamber 35 arranged to be filled with fluid in response to an increase in fluid pressure in said body 31. Movement of the plurality of pistons 34 relative to body 31 also causes activation member 33 to move relative to said body 31. A plurality of ports is formed in said activation member 33 to enable fluid to flow into each of said pressure chambers 35 such that an increase in fluid pressure in body 31 increases fluid pressure within each said pressure chambers 35 to move each of the plurality of pistons 34 and cause activation member 33 to move relative to body 31.

Each of said cutter blocks 32 has at least one outwardly facing sharp edge 32*a* which is arranged to be driven into a surrounding well casing to perforate the well casing. When activation member 33 moves in response to fluid pressure, the cutter blocks 32 are forced into an outwardly deployed position to drive said at least one edge 32*a* into the surrounding well casing (not shown) to perforate said well casing. At least one return spring 36 is provided to return the cutter blocks 32 to the inwardly retracted position when fluid pressure is reduced in the bore of activation member 33.

In a preferred embodiment, said mechanical perforating assembly 30 comprises an upper connection member 37, which can be a threaded female or "box-end" connection, as well as lower connection member 38, which can be a threaded male or "pin end" connection. Connection members 37 and 38 can be used to connect said mechanical perforating assembly 30 to a tubular work string or other component of bottom hole assembly/BHA.

Said mechanical perforating assembly 30 can be conveyed into a wellbore on a tubular work string, either alone or as part of a BHA. Fluid is pumped from the surface to force said at least one cutting blade 32 to extend radially outward from body 31 toward the inner surface of surrounding casing. As said blade(s) 32 extend radially outward, the blade(s) 32 (including sharp outer surface 32*a*) contact the surrounding casing and eventually pierce and/or penetrate said casing in order to form holes or perforations that extend through the casing.

Mechanical perforating assembly 30 is safe and explosive-free, can be easily transported to remote locations (such as drilling rig or marine installation). Unlike conventional explosive-type perforating tools, said mechanical perforating assembly 30 is not limited by tripping guns or pumping sand. Mechanical perforating assembly 30 is fully compatible with and can be run with bridge plugs, packers, and other conventional wellbore cleaning devices. Further, mechanical perforating assembly 30 permits a virtually unlimited number of repeatable cuts or perforations per run within a wellbore. As such, said mechanical perforating assembly 30 allows continuous casing cutting and perforating operations until desired fluid flow rates (in or out) of the surrounding casing are achieved.

Figure 7:
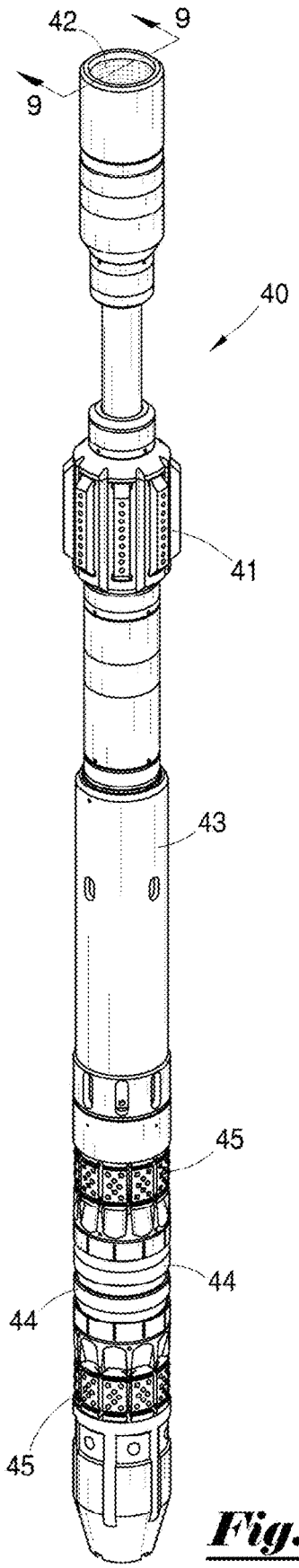
FIG. 7 depicts a side perspective view of a composite (drillable) cement retainer.
Figure 9A:
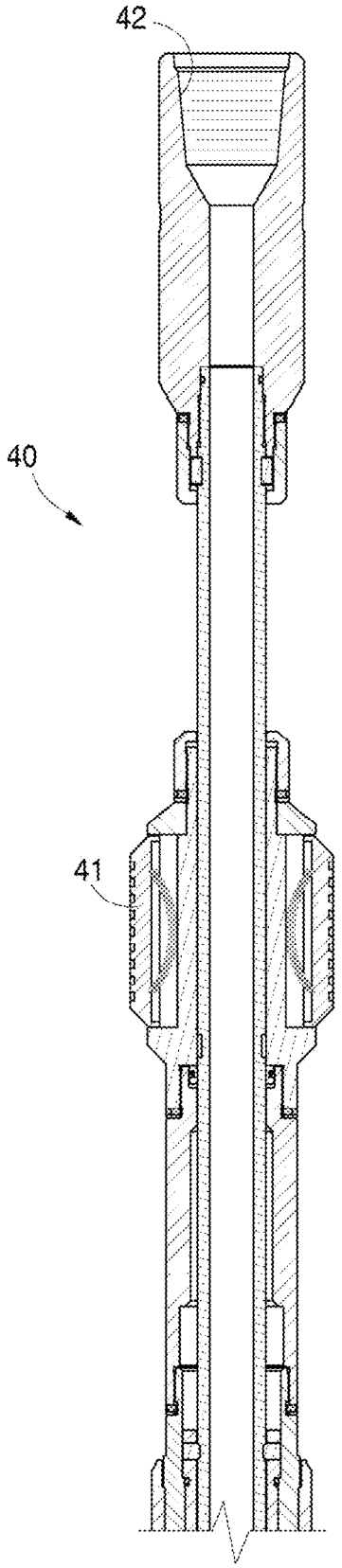
FIGS. 9A and 9B depict a side sectional view of the composite (drillable) cement retainer along line 9-9 of FIG. 7.
Figure 9B:
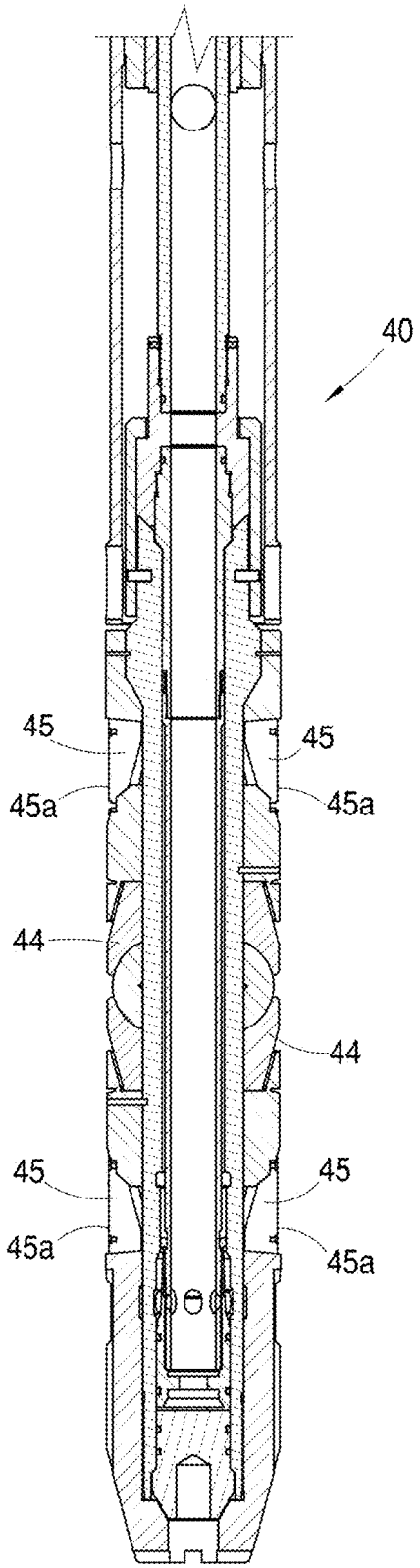

FIG. 7 depicts a side perspective view of a composite (drillable) cement retainer 40, while FIGS. 9A and 9B depict a side sectional view of a composite (drillable) cement retainer 40 along line 10-10 of FIG. 7. A drillable cement retainer can be utilized for most cementing applications. Said drillable cement retainer 40 is designed to function as a drillable squeeze packer which, after cementing, acts as a plug, that traps pressurized cement slurry below the retainer. Further, the drillable cement retainer 40 isolates the newly cemented area from fluid pressures that are present above said cement retainer 40.

Although components of said composite cement retainer 40 can vary, said composite cement retainer 40 can generally comprise upper connection member 42, which comprises a threaded female or "box-end" connection that can be used to connect said composite cement retainer 40 to a tubular work string or other component of bottom hole assembly/BHA. Said composite cement retainer 40 can further comprise body member 43 and friction-promoting drag block assembly 41. At least one rubber or elastomeric sealing member 44 and a plurality of slip members 45 are disposed around said composite cement retainer 40. Each slip member 45 can have raised or textured outer surfaces 45*a* to enhance frictional gripping force when said slip members 45 are extended radially outward to engage against and grip against a surrounding wellbore surface. Other components of composite cement retainer 40 are also depicted in FIGS. 7 and FIGS. 9A-9B that are not expressly expanded upon in detail herein yet are well known to those having ordinary skill in the art.

Figure 8:
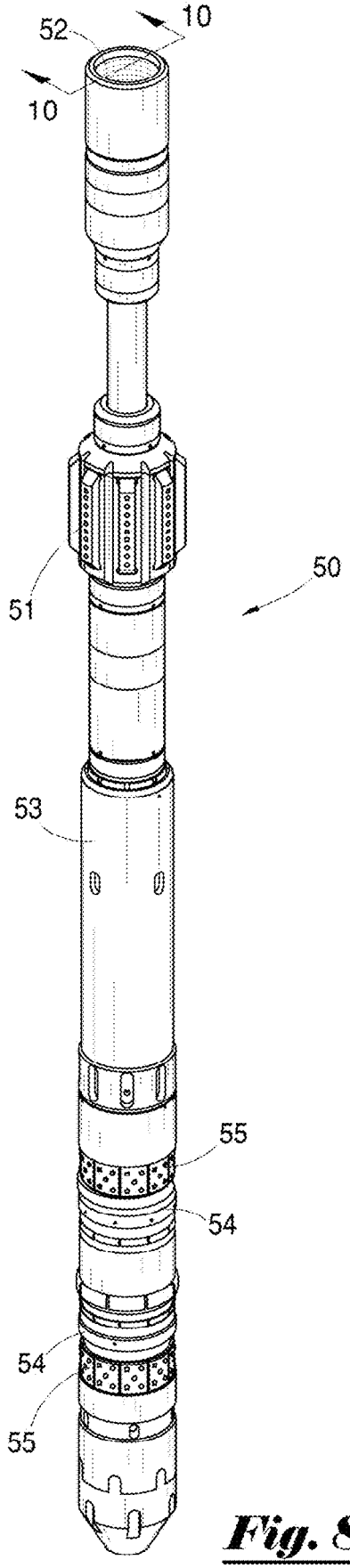
FIG. 8 depicts a side perspective view of a cast-iron bridge plug.
Figure 10A:
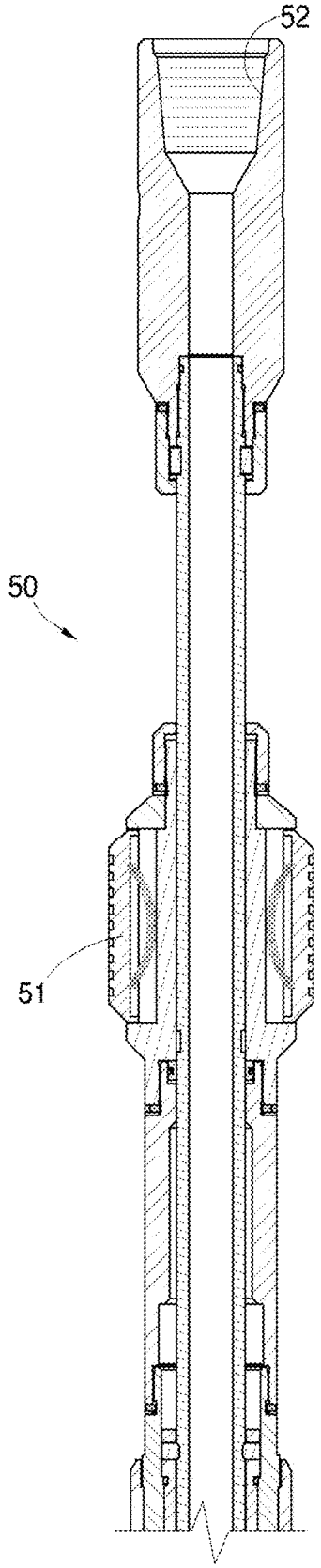
FIGS. 10A and 10B depict a side sectional view of a cast-iron bridge plug along line 10-10 of FIG. 8.
Figure 10B:
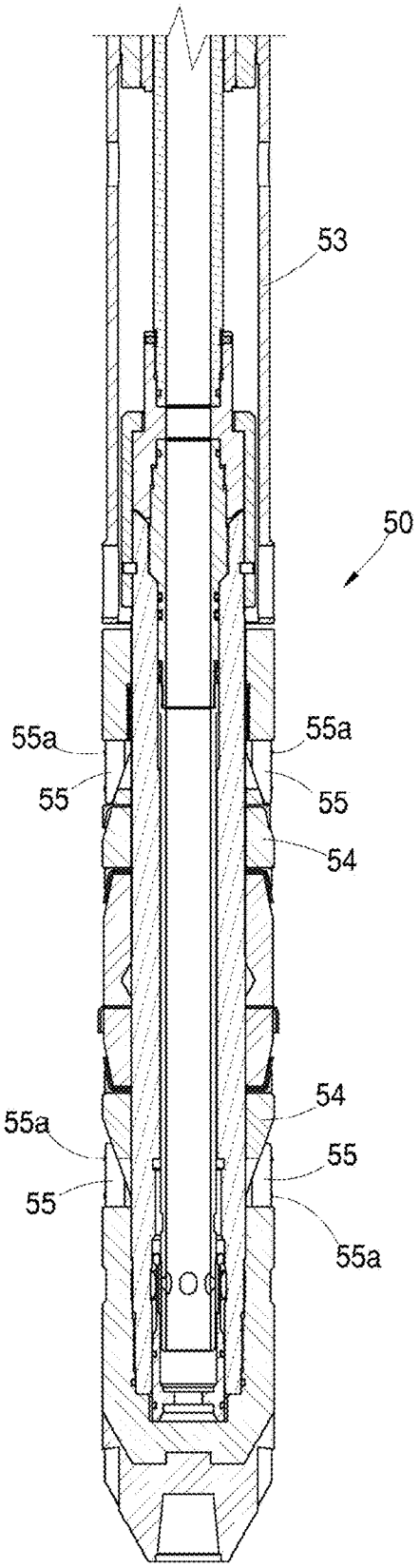

FIG. 8 depicts a side perspective view of a cast-iron bridge plug 50, while FIGS. 10A and 10B depict a side sectional view of said cast-iron bridge plug 50 along line 9-9 of FIG. 8. Bridge plugs are also commonly used during oil and gas operations to isolate certain downhole region(s) of a wellbore from certain other downhole region(s) of said wellbore. A bridge plug can also be selectively set downhole at a desired location within a wellbore to establish a fluid pressure seal or pressure barrier within said wellbore. Some bridge plugs are designed to be retrievable from a wellbore, while others are intended to be permanently set in place.

Although components of said cast-iron bridge plug 50 can vary, said cast-iron bridge plug 50 can generally comprise upper connection member 52, which comprises a threaded female or "box-end" connection that can be used to connect said cast-iron bridge plug 50 to a tubular work string or other component of bottom hole assembly/BHA. Said cast-iron bridge plug 50 can further comprise body member 53 and friction-promoting drag block assembly 51. At least one rubber or elastomeric sealing member 54 and a plurality of slip members 55 are disposed around said cast-iron bridge plug 50. Each slip member 55 can have raised or textured outer surfaces 55*a* to enhance frictional gripping force when said slip members 55 are extended radially outward to engage against and grip against a surrounding wellbore surface. Other components of cast-iron bridge plug 50 are also depicted in FIGS. 8 and FIGS. 10A-10B that are not expressly expanded upon in detail herein yet are well known to those having ordinary skill in the art.

Figure 11A:
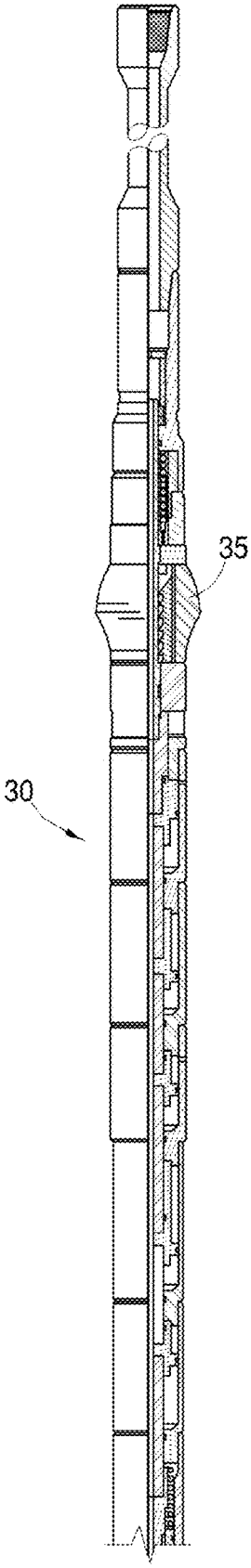
FIGS. 11A through 11C depict a side partial cut-away view of a first bottom hole assembly configuration of the present invention.
Figure 11B:
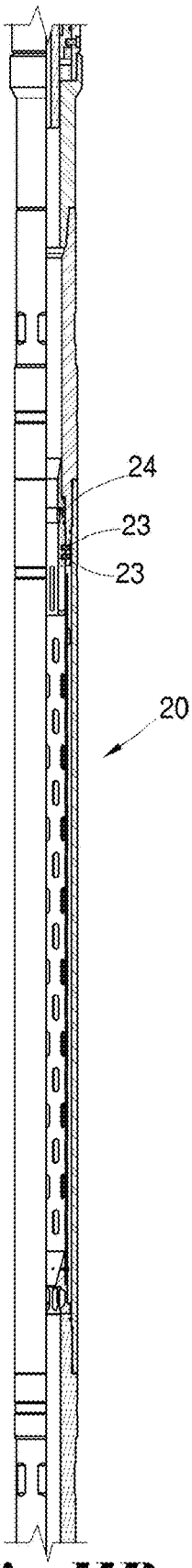
Figure 11C:
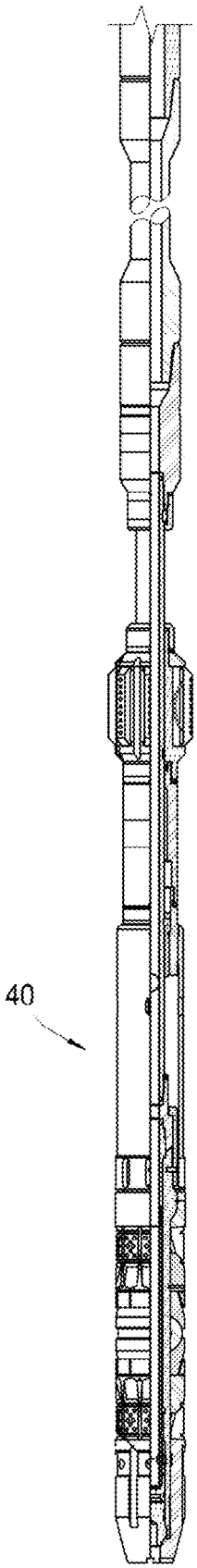
Figure 12A:
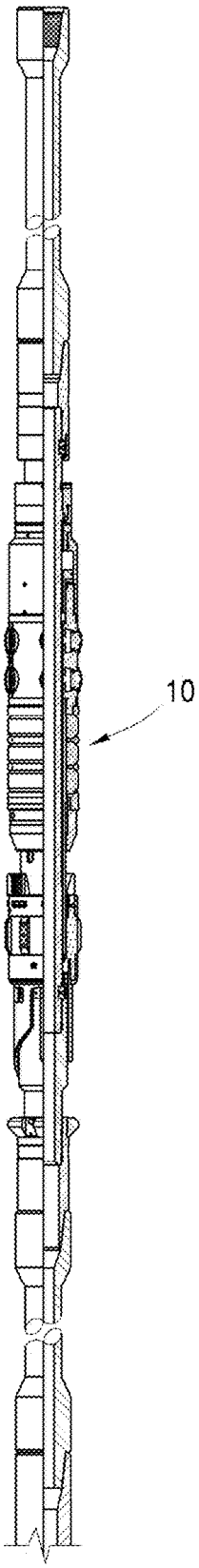
FIGS. 12A through 12D depict a side partial cut-away view of a second alternative bottom hole assembly configuration of the present invention.
Figure 12B:
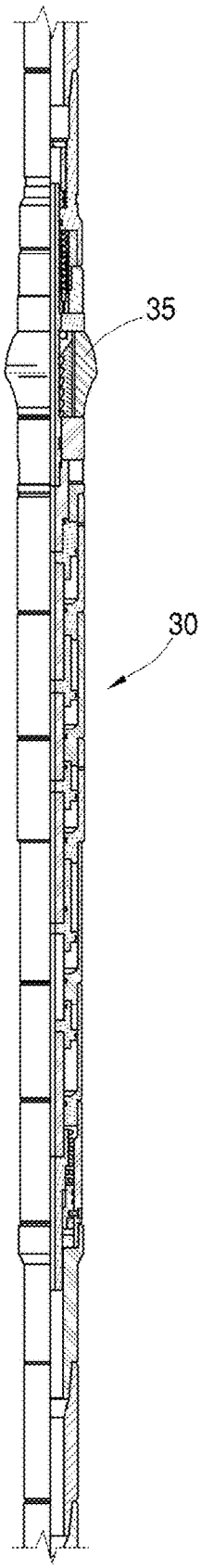
Figure 12C:
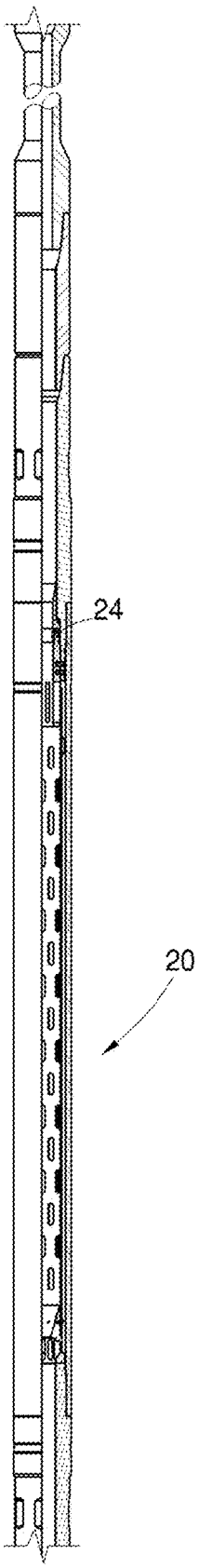
Figure 12D:
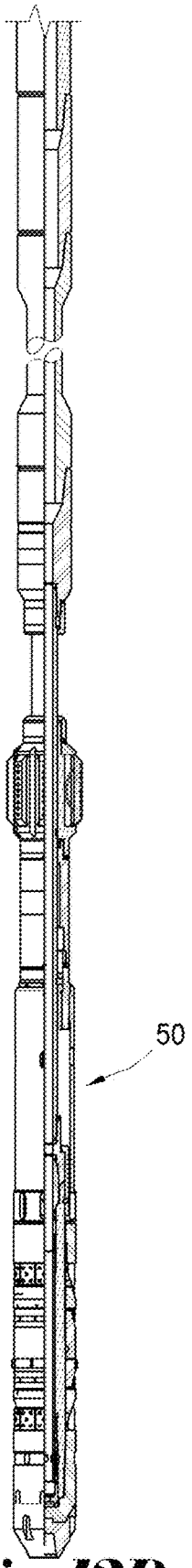
Figure 13A:
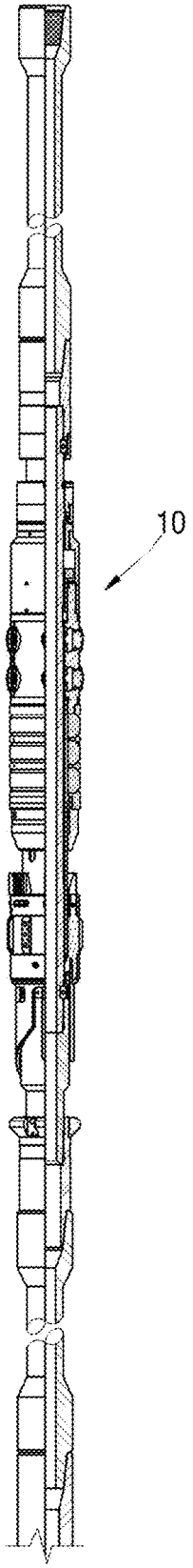
FIGS. 13A through 13D depict a side partial cut-away view of a third alternative bottom hole assembly configuration of the present invention.
Figure 13B:
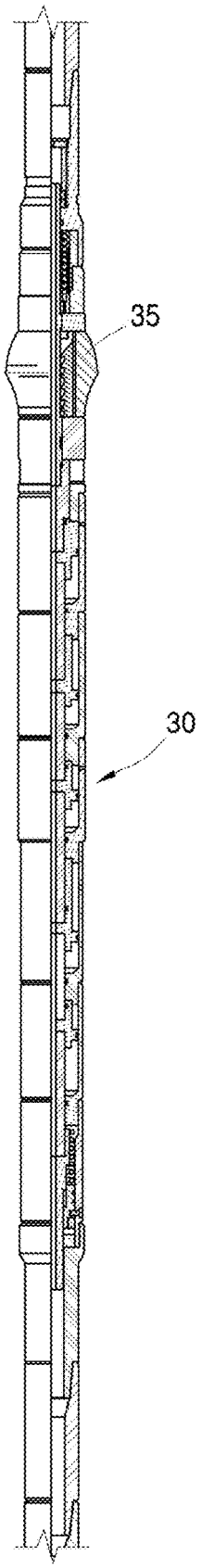
Figure 13C:
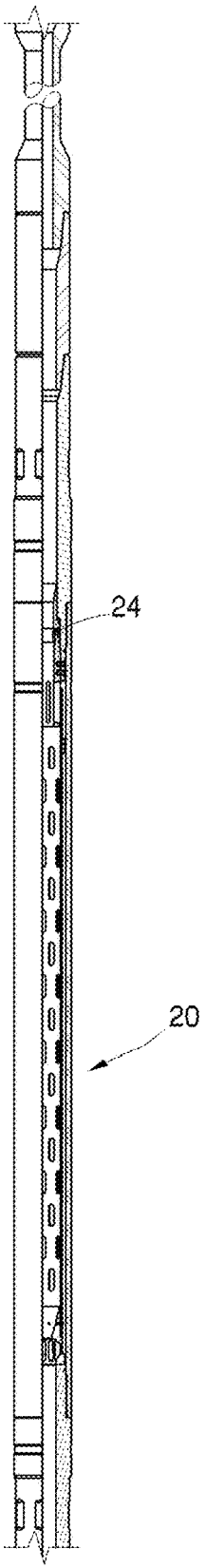
Figure 13D:
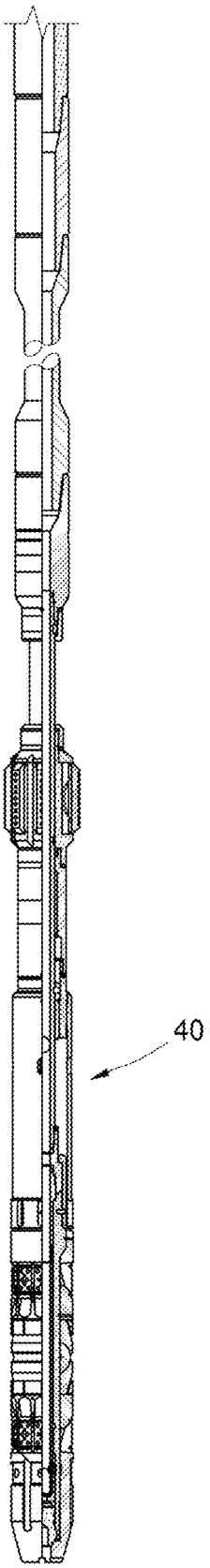

FIGS. 11A through 11C depict a side partial cut-away view of a first bottom hole assembly configuration of the present invention. In the embodiment depicted in FIGS. 11A through 11C, as well as the following described method of using said embodiment, a BHA is configured to include composite/drillable cement retainer 40, dart catcher/ball sub 20 and mechanical perforating assembly 30. Said BHA is operationally attached to a conventional work string (not pictured in FIGS. 11A-11C) and can be conveyed to a desired downhole depth within a wellbore.

After said BHA is positioned at a desired depth (that is, a downhole location within a wellbore), fluid can be pumped through said tubular work string and BHA. After pumping operations cease, an activation ball can be launched in said work string; said ball is typically launched at the surface and permitted to fall until it lands on seat 24 of dart catcher/ball sub 20. After landing on said seat 24, said dropped ball forms an obstruction blocking fluid flow through said seat 24; thus, fluid can be pumped down the work string until fluid pressure reaches a predetermined maximum anticipated fluid pressure, resulting in a pressure differential being created across said ball and seat.

Said fluid pressure can be used to actuate mechanical perforating assembly 30 by extending cutter blades 35 of said mechanical perforating assembly 30 radially outward. After being extended radially outward, said cutter blades 35 can move with sufficient force to perforate or pierce any surrounding casing string. Fluid pressure from said work string is monitored; if no fluid pressure increase is observed, then a predetermined amount of fluid pressure can be bled off from said work string.

At this point, said work string can be picked up, typically with an annular blow out preventer ("BOP") closed around the external surface of said work string, resulting in said work string "stripping through" said annular BOP. Cutter blades 35 can be retracted radially inward and released from contacting the surrounding casing. The pick-up weight can be observed when picking up said work string pulling said BHA though the perforated interval of the casing. Additionally, a negative flow check can be performed (such as, for example, through a choke/kill line lined up to trip tank) to determine whether any reservoir fluids are flowing into the wellbore through perforations in said casing.

After the wellbore is confirmed to be static with no flow into said wellbore, fluid can be pumped down the choke/kill line to perform an injectivity test in order to verify that the casing has been perforated and establish fluid injection rates. If fluid cannot be injected into said perforations, or if there is no other observable indication to confirm the casing has been perforated, then the perforating procedure can be repeated as desired in order to ensure that the casing has been perforated.

After confirming that the casing has been perforated, then fluid can again be pumped down the work string. Said dropped ball remains on said seat 24, forming an obstruction that blocks fluid flow through said seat 24. Fluid can be pumped down said work string to a predetermined seat yield pressure, eventually shearing at least one shearable member 23 and causing said seat 24 to shift downward. After said seat 24 has been shifted, pumping of fluid can cease and any existing fluid pressure can be bled off of said work string.

The work string can be pulled out of the well until composite drillable cement retainer 40 of the BHA is positioned above the uppermost perforation in the casing. Said composite drillable cement retainer 40 can be set at a desired location in said wellbore (above said uppermost casing perforation), and a cementing stand or pump-in sub can be installed at the upper surface (such as a drilling rig). Typically, in order to ensure proper placement within the wellbore, the last movement of the work string should be in a down stroke motion when setting said composite drillable cement retainer 40.

Said conventional work string can then be rotated, typically to the right, in order to transmit torque forces to the BHA and release the slips from the setting sleeve. The work string can be picked up and overpull tension can be applied in order to set said composite drillable cement retainer 40 within said wellbore. Said overpull tension can be staged starting at the minimum tension for the appropriate size tool and increased to the midpoint tension for the appropriate size tool. Overpull can the be increased to the maximum tension for the appropriate size tool. Weight of the work string can then be slacked off in order to verify that said composite drillable cement retainer 40 is set within the casing. The annulus above said composite drillable cement retainer 40 can be pressure tested by closing the BOP and pumping fluid down annulus formed between the external surface of the work string and the inner surface of the casing in order to confirm annular pressure integrity.

The mechanical setting tool can then be released from said composite drillable cement retainer 40. The work string can then be further rotated (typically to the right), in order to shear rotational lock screws of said composite drillable cement retainer 40 and allow a control latch to unscrew from said composite drillable cement retainer 40. In the event that cement slurry is to be bull-headed, then a stinger of said composite drillable cement retainer 40 should beneficially remain stung into said composite drillable cement retainer 40. However, if a cement slurry is to be spotted within the wellbore, a stinger of said composite drillable cement retainer 40 should be fully released from said composite drillable cement retainer 40.

When bull-heading cement slurry downhole in a wellbore (typically through perforations in casing), at least one BOP should be closed against the work string. Fluid pressure of said annular area should be (and remain) higher than fluid pressure of the work string. Cement slurry can be pumped down the work string, out of said work string and into the squeeze area(s). After said cement slurry has been displaced from said work string, the stinger can be pulled out of said composite drillable cement retainer 40 by picking up on the work string. Thereafter, fluid can be reverse circulated down the annulus and through the work string to clean the wellbore of any cement.

When cement slurry is to be spotted, the work string can be picked up until said stinger is removed from said composite drillable cement retainer 40. Fluid back pressure should be maintained using a surface manifold to stop cement slurry from falling in the work string. Weight can be slacked off from the work string to a desired cementing position and said stinger can be stung into said composite drillable cement retainer 40. A desired amount of weight from said work string can be slacked off onto said composite drillable cement retainer 40. Thereafter, a desired volume of cement slurry can be pumped into the wellbore and any open casing perforations. After said cement slurry has been displaced from said work string, the stinger can be pulled out of said composite drillable cement retainer 40 by picking up on the work string. Thereafter, fluid can be reverse circulated down the annulus and through the work string to clean the wellbore of any cement.

After the cement squeeze job has been completed, a balanced cement plug can be spotted above the composite drillable cement retainer 40 if desired. The mechanical setting tool can be positioned above calculated top of cement, and fluid can be circulated through the work string and up the annulus to ensure there is no undesirable cement slurry remaining in the wellbore or BHA. After the well is observed to be static with no fluid feed in from the perforations, then the work string and BHA can be pulled out of the wellbore.

FIGS. 12A through 12D depict a side partial cut-away view of a second alternative bottom hole assembly configuration of the present invention. In the embodiment depicted in FIGS. 12A through 12D, as well as the following described method of using said second alternative embodiment, a BHA is configured to include a cast-iron bridge plug 50, dart catcher/ball sub 20, mechanical perforating assembly 30 and retrievable service packer 10. Said BHA is operationally attached to a work string and can be conveyed to a desired downhole depth within a wellbore.

When conveying said BHA into a wellbore, a desired length of pipe (typically a desired number of pipe sections) is used to space out or create a desired distance between said dart catcher/ball sub 20 and mechanical perforating assembly 30 in desired spacing above a mechanical setting tool. Similarly, a desired length of pipe (typically a desired number of pipe sections) is used to space out. or create a desired distance between said mechanical perforating assembly 30 and said retrievable service packer 10.

The work string can be rotated to transmit torque force to said retrievable service packer 10 in a direction that will manipulate retrievable service packer 10 into a set position. Thereafter, weight of said work string can be slacked off and set down on said retriable service packer 10 in order to apply compressive forces to energize said retrievable service packer 10. Once compression force is applied to the tool, said sealing elements energize, and the fluid bypass of said retrievable service packer 10 closes, thereby isolating the annulus from the internal through bore of the work string. At this point, a BOP (typically an annular BOP to permit said work string to be stripped through) is closed against the outer surface of said work string. Fluid can be pumped into said annulus to test the fluid pressure integrity of said annular space.

Perforating operations can be performed in a closed system in the event that a pressure differential exists in the annulus that will be exposed once the casing has been perforated. An activation ball can be launched in said work string; said ball is typically launched at the surface and permitted to fall until it lands on seat 24 of dart catcher/ball sub 20. After landing on said seat 24, said dropped ball forms an obstruction blocking fluid flow through said seat 24; thus, fluid can be pumped down the work string until fluid pressure reaches a predetermined maximum anticipated fluid pressure, resulting in a pressure differential being created across said ball and seat.

Said fluid pressure can be used to actuate mechanical perforating assembly 30 by extending cutter blades 35 of said mechanical perforating assembly 30 radially outward. After being extended radially outward, said cutter blades 35 can move with sufficient force to perforate or pierce any surrounding casing string. Fluid pressure from said work string is monitored; if no fluid pressure increase is observed, then a predetermined amount of fluid pressure can be bled off from said work string.

Figure 14A:
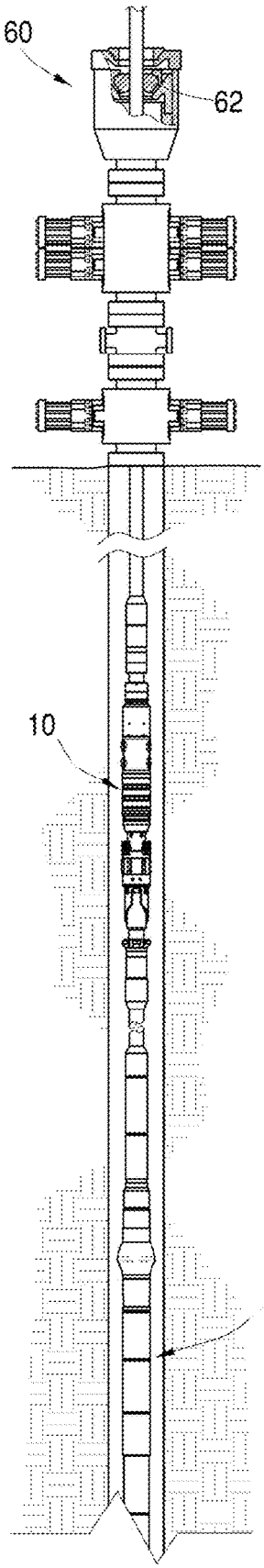
FIGS. 14A and 14B depict a side partial cut-away view of a second alternative bottom hole assembly configuration of the present invention in use with an annular blow out preventer.
Figure 14B:
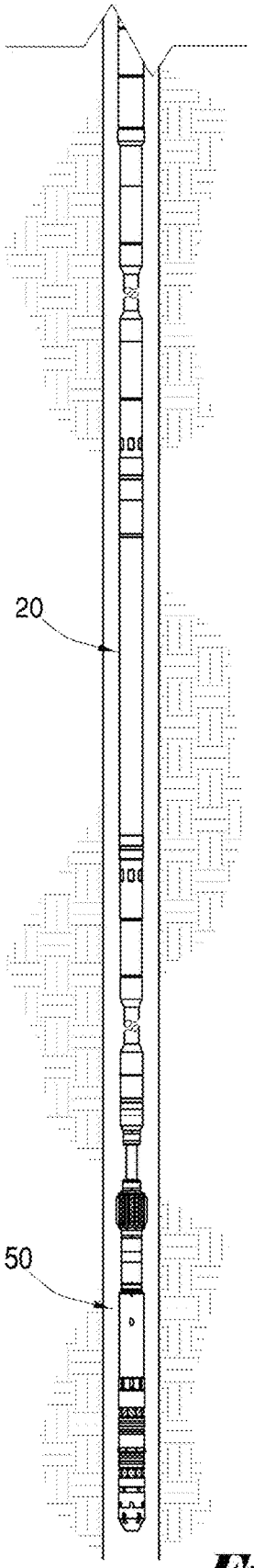

At this point, said work string can be picked up, typically with an annular blow out preventer ("BOP") closed around the external surface of said work string, resulting in said work string "stripping through" said annular BOP. FIGS. 14A and 14B depict a side partial cut-away view of said second alternative bottom hole assembly configuration with said work string "stripping through" said annular BOP. Said retrievable service packer can be unseated, and cutter blades 35 can be retracted radially inward and released from contacting the surrounding casing. The pick-up weight can be observed when picking up said work string pulling said BHA though the perforated interval of the casing. Additionally, a flow check can be performed (such as, for example, through a choke/kill line lined up to trip tank) to determine whether any reservoir fluids are flowing into the wellbore through perforations in said casing.

After the wellbore is confirmed to be static with no flow into said wellbore, fluid can be pumped down the choke/kill line to perform an injectivity test in order to verify that the casing has been perforated and establish fluid injection rates. If fluid cannot be injected into said perforations, or if there is no other observable indication to confirm the casing has been perforated, then the perforating procedure can be repeated as desired in order to ensure that the casing has been perforated. Said work string can be rotated to apply torque for to said retrievable service packer 10 to ensure that said retrievable service packer 10 is placed back into the run in hole condition (that is, slip retracted radially inward, sealing members disengaged and fluid flow bypass in the open position).

Said work string can be pulled out of the wellbore until cast-iron bridge plug 50 is positioned above the uppermost perforation in the casing. Ensuring that the last movement of the work string is done in a downward motion will position retrievable service packer 10 in a "run-in-hole" position and prevent said retrievable service packer 10 from moving into a "SET" position when setting said cast-iron bridge plug 50. The work string can be rotated to transmit torque force to said cast-iron bridge plug 50 in order to release the slips from a setting sleeve. The work string can be picked up in order to apply overpull tension to set said cast-iron bridge plug 50 within said wellbore.

The mechanical setting tool can then be released from said cast-iron bridge plug 50. The work string can then be further rotated (typically to the right), in order to shear rotational lock screws of said cast-iron bridge plug 50. In the event that cement slurry is to be bull-headed, then a stinger of said cast-iron bridge plug 50 should remain stung into said cast-iron bridge plug 50. However, if a cement slurry is to be spotted within the wellbore, a stinger of said cast-iron bridge plug 10 should be fully released from said cast-iron bridge plug 50.

When bull-heading cement slurry downhole in a wellbore (typically through perforations in casing), at least one BOP should be closed against the work string. Fluid pressure of said annular area should be (and remain) higher than fluid pressure of the work string. Cement slurry can be pumped down the work string, out of said work string and into the squeeze area(s). After said cement slurry has been displaced from said work string, the stinger can be pulled out of said cast-iron bridge plug by picking up on the work string. Thereafter, fluid can be reverse circulated down the annulus and through the work string to clean the wellbore of any cement When cement slurry is to be spotted, the work string can be picked up until said stinger is removed from said cast-iron bridge plug 50. Fluid back pressure should be maintained using a surface manifold to stop cement slurry from falling in the work string. Weight can be slacked off from the work string to a desired cementing position and said stinger can be stung into said cast-iron bridge plug 50. A desired amount of weight from said work string can be slacked off onto said cast-iron bridge plug 50. Thereafter, a desired volume of cement slurry can be pumped into the wellbore and any open casing perforations. After said cement slurry has been displaced from said work string, the stinger can be pulled out of said cast-iron bridge plug 50 by picking up on the work string. Thereafter, fluid can be reverse circulated down the annulus and through the work string to clean the wellbore of any cement.

After the cement squeeze job has been completed, a balanced cement plug can be spotted above said cast-iron bridge plug 50 if desired. The mechanical setting tool can be positioned above calculated top of cement, and fluid can be circulated through the work string and up the annuus to ensure there is no undesirable cement slurry remaining in the wellbore or BHA. After the well is observed to be static with no fluid feed in from the perforation, then the work string and BHA can be pulled out of the wellbore.

FIGS. 13A through 13D depict a side partial cut-away view of a third alternative bottom hole assembly configuration of the present invention. In the third alternative embodiment depicted in FIGS. 13A through 13D, as well as the following described method of using said embodiment, a BHA is configured to include composite/drillable cement retainer 40, dart catcher/ball sub 20, retrievable service packer 10 and mechanical perforating assembly 30. Said BHA is operationally attached to a work string and can be conveyed to a desired downhole depth within a wellbore.

When conveying said BHA into a wellbore, a desired length of pipe (typically a desired number of pipe sections) is used to space out or create a desired distance between said dart catcher/ball sub 20 and mechanical perforating assembly 30 in desired spacing above a mechanical setting tool. Similarly, a desired length of pipe (typically a desired number of pipe sections) is used to space out. or create a desired distance between said mechanical perforating assembly 30 and said retrievable service packer 10.

The work string can be rotated to transmit torque force to said retrievable service packer 10 in a direction that will manipulate retrievable service packer 10 into a set position. Thereafter, weight of said work string can be slacked off and set down on said retriable service packer 10 in order to apply compressive forces to energize said retrievable service packer 10. Once compression force is applied to the tool, sealing elements of said service packer 10 energize, and the fluid bypass of said retrievable service packer 10 closes, thereby isolating the annulus from the internal through bore of the work string. At this point, a BOP (typically an annular BOP to permit said work string to be stripped through) is closed against the outer surface of said work string. Fluid can be pumped into said annulus to test the fluid pressure integrity of said annular space.

Perforating operations can be performed in a closed system in the event that a pressure differential exists in the annulus that will be exposed once the casing has been perforated. An activation ball can be launched in said work string; said ball is typically launched at the surface and permitted to fall until it lands on seat 24 of dart catcher/ball sub 20. After landing on said seat 24, said dropped ball forms an obstruction blocking fluid flow through said seat 24; thus, fluid can be pumped down the work string until fluid pressure reaches a predetermined maximum anticipated fluid pressure, resulting in a pressure differential being created across said ball and seat.

Said fluid pressure can be used to actuate mechanical perforating assembly 30 by extending cutter blades 35 of said mechanical perforating assembly 30 radially outward. After being extended radially outward, said cutter blades 35 can move with sufficient force to perforate or pierce any surrounding casing string. Fluid pressure from said work string is monitored; if no fluid pressure increase is observed, then a predetermined amount of fluid pressure can be bled off from said work string.

Figure 15A:
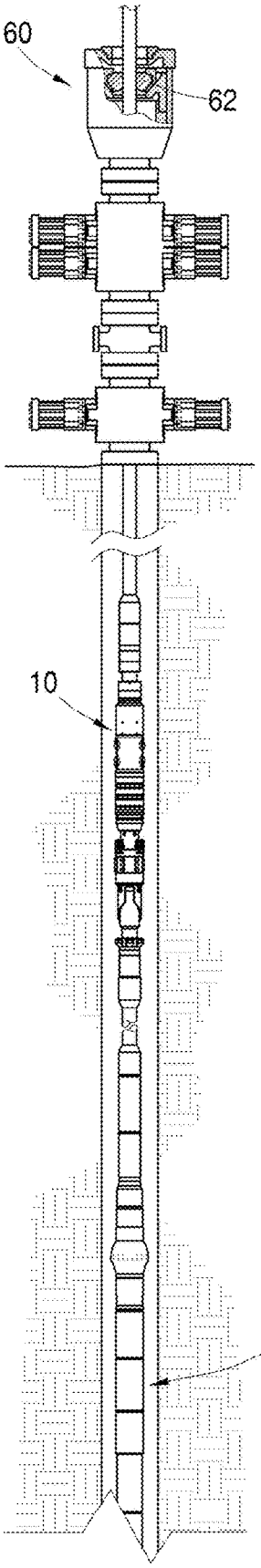
FIGS. 15A and 15B depict a side partial cut-away view of a third alternative bottom hole assembly configuration of the present invention configured in use with an annular blow out preventer.
Figure 15B:
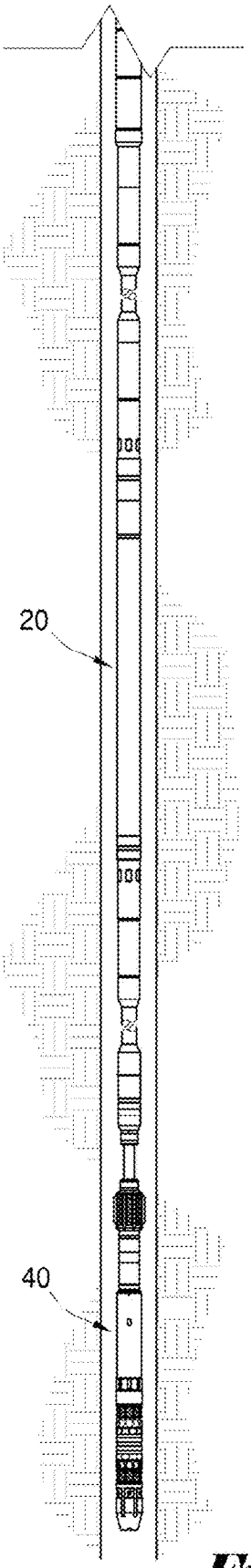

At this point, said work string can be picked up, typically with an annular blow out preventer ("BOP") closed around the external surface of said work string, resulting in said work string "stripping through" said annular BOP. FIGS. 15A and 15B depict a side partial cut-away view of said third alternative bottom hole assembly configuration with said work string "stripping through" said annular BOP. Said retrievable service packer can be unseated, and cutter blades 35 can be retracted radially inward and released from contacting the surrounding casing. The pick-up weight can be observed when picking up said work string and pulling said BHA though the perforated interval of the casing. Additionally, a negative flow check can be performed (such as, for example, through a choke/kill line lined up to trip tank) to determine whether any reservoir fluids are flowing into the wellbore through perforations in said casing.

After the wellbore is confirmed to be static with no fluid flow into said wellbore, fluid can be pumped down the choke/kill line to perform an injectivity test in order to verify that the casing has been perforated and to establish fluid injection rates into formations(s) outside said casing. If fluid cannot be injected into said perforations, or if there is no other observable indication to confirm the casing has been perforated, then the perforating procedure can be repeated as desired in order to ensure that the casing has been perforated. Said work string can be rotated to apply torque for to said retrievable service packer 10 to ensure that said retrievable service packer 10 is placed back into the run-in-hole condition (that is, slip retracted radially inward, sealing members disengaged and fluid flow bypass in the open position).

Said work string can be pulled out of the wellbore until composite/drillable cement retainer 40 is positioned above the uppermost perforation in the casing. Ensuring that the last movement of the work string is done in a downward motion will position retrievable service packer 10 in a "run-in-hole" position and prevent said retrievable service packer 10 from moving into a "SET" position when setting said cast-iron bridge plug 50. The work string can be rotated to transmit torque force to said composite/drillable cement retainer 40 in order to release a stinger. Overpull tension can be applied to said composite/drillable cement retainer 40.

The mechanical setting tool can then be released from said composite drillable cement retainer 40. The work string can then be further rotated (typically to the right), in order to shear rotational lock screws of said composite drillable cement retainer 40 and allow the control latch to unscrew from said composite drillable cement retainer 40. In the event that cement slurry is to be bull-headed, then a stinger of said composite drillable cement retainer 40 should remain stung into said composite drillable cement retainer 40. However, if a cement slurry is to be spotted within the wellbore, a stinger of said composite drillable cement retainer 40 should be fully released from said composite drillable cement retainer 40.

When bull-heading cement slurry downhole in a wellbore (typically through perforations in casing), at least one BOP should be closed against the work string. Fluid pressure of said annular area should be (and remain) higher than fluid pressure of the work string. Cement slurry can be pumped down the work string, out of said work string and into the squeeze area(s). After said cement slurry has been displaced from said work string, the stinger can be pulled out of said composite drillable cement retainer 40 by picking up on the work string. Thereafter, fluid can be reverse circulated down the annulus and through the work string to clean the wellbore of any cement.

When cement slurry is to be spotted, the work string can be picked up until said stinger is removed from said composite drillable cement retainer 40. Fluid back pressure should be maintained using a surface manifold to stop cement slurry from falling in the work string. Weight can be slacked off from the work string to a desired cementing position and said stinger can be stung into said composite drillable cement retainer 40. A desired amount of weight from said work string can be slacked off onto said composite drillable cement retainer 40. Thereafter, a desired volume of cement slurry can be pumped into the wellbore and any open casing perforations. After said cement slurry has been displaced from said work string, the stinger can be pulled out of said composite drillable cement retainer 40 by picking up on the work string. Thereafter, fluid can be reverse circulated down the annulus and through the work string to clean the wellbore of any cement.

After the cement squeeze job has been completed, a balanced cement plug can be spotted above the composite drillable cement retainer 40 if desired. The mechanical setting tool can be positioned above calculated top of cement, and fluid can be circulated through the work string and up the annuus to ensure there is no undesirable cement slurry remaining in the wellbore or BHA. After the well is observed to be static with no fluid feed in from the perforations, then the work string and BHA can be pulled out of the wellbore.

A baffle can be used in this application/configuration to ensure once the mechanical perforating assembly has completed cutting into the internal surface of the casing the ball seat and the activation ball can be safety recovered from the well. The dart catcher/ball sub 20 can also be used in this configuration during cement operations wherein the cementation darts will temporarily be held on an indication seat until enough pressure is applied to the work string to push said dart through the indication seat and into a cage. In the dart catcher/ball sub assembly 20 both operations can be performed without the addition of pulling out of the hole with the assembly (i.e. perforations are made by the mechanical perforating tool, then the drillable cement retainer and/or bridge plug is set, then a cement job is completed).

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for performing downhole perforating and cementing operations in a cased well bore comprising:

a) configuring a bottom hole assembly comprising:
   i) a composite drillable cement retainer;
   ii) a dart catcher ball sub;
   iii) a mechanical perforating device;

b) conveying said bottom hole assembly into a well bore on a tubular work string;

c) perforating casing in said well bore with said mechanical perforating device to create perforations in said casing;

d) positioning said composite drillable cement retainer above an uppermost perforation in said casing;

e) setting said composite drillable cement retainer in said well bore; and f) performing downhole cementing operations in said well bore.

2. The method of claim 1, wherein said composite drillable cement retainer further comprises a stinger member removably disposed within a drillable cement retainer body.

3. The method of claim 2, wherein said downhole cementing operations further comprise pumping cement slurry into perforations in said casing.

4. The method of claim 3, wherein said step of pumping cement slurry further comprises pumping said cement slurry through said tubular work string and stinger of said composite drillable cement retainer, and into said perforations in said casing.

5. The method of claim 2, wherein said downhole cementing operations further comprise:

a) removing said stinger from said composite drillable cement retainer; and b) pumping a predetermined volume of cement slurry out of said stinger above said composite drillable cement retainer to form a cement plug within said casing.

6. The method of claim 5, further comprising:

a) positioning said mechanical setting tool above said cement plug; and b) circulating fluid in said well bore to remove undesired cement slurry from said well bore.

7. A method for performing downhole perforating and cementing operations in a cased well bore comprising:

a) configuring a bottom hole assembly comprising:

i) a cast-iron bridge plug;

ii) a dart catcher ball sub;

iii) a mechanical perforating device, wherein said mechanical perforating device is spaced a predetermined distance from said dart catcher ball sub; and iv) a retrievable service packer;

b) conveying said bottom hole assembly into a well bore on a tubular work string;

c) setting said retrievable service packer in said well bore;

d) perforating casing in said well bore with said mechanical perforating device to create perforations in said casing;

e) closing an annular blow out preventer around said tubular work string; and f) stripping through said closed annular blow out preventer with said tubular work string.

8. The method of claim 7, further comprising:

a) positioning said cast-iron bridge plug above an uppermost perforation in said casing; and b) setting said cast-iron bridge plug in said well bore above said uppermost perforation in said casing.

9. The method of claim 8, wherein said cast-iron bridge plug further comprises a stinger member removably disposed within a plug body.

10. The method of claim 9, wherein said downhole cementing operations further comprise pumping cement slurry into perforations in said casing.

11. The method of claim 10, wherein said step of pumping cement slurry further comprises pumping said cement slurry through said tubular work string and said stinger of said cast-iron bridge plug, and into said perforations in said casing.

12. The method of claim 9, wherein said downhole cementing operations further comprise:

a) removing said stinger from said cast-iron bridge plug; and b) pumping a predetermined volume of cement slurry out of said stinger above said cast-iron bridge plug to form a cement plug within said casing.

13. A method for performing downhole perforating and cementing operations in a cased well bore comprising:

a) configuring a bottom hole assembly comprising:

i) a composite drillable cement retainer;

ii) a dart catcher ball sub;

iii) a mechanical perforating device, wherein said mechanical perforating device is spaced a predetermined distance from said dart catcher ball sub; and iv) a retrievable service packer;

b) conveying said bottom hole assembly into a well bore on a tubular work string;

c) setting said retrievable service packer in said well bore; and d) perforating casing in said well bore with said mechanical perforating device to create perforations in said casing e) closing an annular blow out preventer around said tubular work string;

f) stripping through said closed annular blow out preventer with said tubular work string; and g) setting said composite drillable cement retainer within said well bore.

14. The method of claim 13, wherein said composite drillable cement retainer further comprises a stinger member removably disposed within a drillable cement retainer body.

15. The method of claim 14, wherein said downhole cementing operations further comprise pumping cement slurry into perforations in said casing.

16. The method of claim 15, wherein said step of pumping cement slurry further comprises pumping said cement slurry through said tubular work string and stinger of said composite drillable cement retainer, and into said perforations in said casing.

17. The method of claim 14, wherein said downhole cementing operations further comprise:

a) removing said stinger from said composite drillable cement retainer; and b) pumping a predetermined volume of cement slurry out of said stinger above said composite drillable cement retainer to form a cement plug within said casing.

18. The method of claim 17, further comprising:

a) positioning said mechanical setting tool above said cement slurry plug; and b) circulating fluid in said well bore to remove undesired cement slurry from said well bore.

* * * * *